United States Patent [19]

Booze

[11] 4,003,528

[45] Jan. 18, 1977

[54] MOUNTING AND BRAKING APPARATUS FOR COILED WELDING WIRE

[76] Inventor: Joe L. Booze, 185 E. Benwood St., Covina, Calif. 91722

[22] Filed: Dec. 31, 1975

[21] Appl. No.: 645,821

[52] U.S. Cl. ..... 242/106; 242/156.2

[51] Int. Cl.[2] ..... B65H 17/52

[58] Field of Search ..... 242/106, 100, 75, 75.4, 242/75.5, 155 R, 156.2

[56] References Cited

UNITED STATES PATENTS

| | | | |
|---|---|---|---|
| 248,261 | 10/1881 | Hubbard | 242/106 |
| 2,734,694 | 2/1956 | Davidson | 242/106 |
| 3,319,906 | 5/1967 | Atkinson | 242/106 |

*Primary Examiner*—Edward J. McCarthy
*Attorney, Agent, or Firm*—J. C. Baisch

[57] ABSTRACT

A mounting and braking apparatus for use in providing a controlled feeding of welding wire to a welding torch or gun, wherein the welding wire is arranged in a pre-coiled, continuous roll. The mounting and braking apparatus comprises an upstanding mounting bracket adapted to be secured to an electrical welding machine having a reel assembly rotatably supported to the mounting bracket by the braking apparatus, which includes a threaded spindle attached to the mounting bracket having an insulating bushing disposed therebetween and held in place by a locking nut. The braking assembly is operably mounted to the extended portion of the spindle and comprises an enlarged hub member having a pair of oppositely disposed ball bearings positioned therein and operably received over the spindle. An adjusting nut is threadably received on the outer end of the spindle for direct contact with one of the bearings, whereby the rate at which the wire is uncoiled from the reel assembly is controlled by the amount of frictional force placed upon the bearing members by the adjusting nut.

6 Claims, 5 Drawing Figures

MOUNTING AND BRAKING APPARATUS FOR COILED WELDING WIRE

BACKGROUND OF THE INVENTION

1. Field of the Invention

This invention relates generally to an electrical welding apparatus of the type wherein a continuous welding wire is required in the operation thereof, and relates more particularly to an apparatus for mounting the welding wire and providing a controlled feeding device by means of a unique braking assembly.

2. Description of the Prior Art

As is well known in the art, various types of welding machines are presently available. However, these units have several inherent problems and difficulties which are generally encountered in their respective operations. One of the major problems with respect to the known devices is providing a proper rate of movement of the wire from its supply location to its discharge point, that generally being the welding torch or gun.

In most applications, the welding wire is arranged in a coil-like manner and must be supported by a reel or spool. From the reel, it is fed into the welding machine, and from there into the welding gun. If the reel is not under constant tension, an over supply of wire is created; hence, jambing occurs, which in turn creates loss of time and money. However, an additional problem occurs when the welding wire can not uncoil fast enough due to excessive tension. Thus, there is a need for a very simple device to overcome these problems, wherein the average operator of a welding machine can, without any great any great skill, adjust the apparatus to the requirement of any particular work situation that might prevail upon him.

SUMMARY OF THE INVENTION

This invention provides an apparatus to control the rate of speed of a speed of a continuous length of welding wire that is fed into any well known electrical welding machine, wherein the welding wire is arranged in a prewound coil adapted to be supported on a rotatable reel whereby the wire must be unwound at a predetermined rate in order to accommodate the operation of the welding machine and to provide the required flow for a particular welding operation.

This is accomplished by the present invention which comprises the combination of a mounting bracket, a reel for supporting a coiled welding wire, and a braking assembly, whereby the uncoiling of the wire can be accurately adjusted for any particular situation or operation.

Included within the overall invention is the mounting bracket arranged to be secured to a welding machine of the type as previously described herein, the bracket being attached thereto in an upright stance, having a slightly outward-inclined position and being held thereto by a brace member.

Secured to the upper, free end of the bracket is a threaded pin or spindle having an insulating bushing interdisposed between the spindle and the bracket to eliminate the possibility of any welding voltage leaking through the assembly, thereby isolating the welding wire coil from the bracket and its related components.

Operably supported on the spindle is the braking assembly comprising a pair of ball bearing means, each of which is mounted in such a manner as to have its outer bearing racers fixed within a reel-supporting hub member, with the respective inner bearing racers mounted over the spindle. Thus, the hub can rotate about the spindle through the ball bearings.

The bearings and the hub member are held in place by an adjusting nut which directly engages the inner racer or raceway of the forward or outer bearing, the inner racers being provided with annular, outwardly extending flanges whereby the adjusting nut abuts one of the flanges.

Accordingly, to adjust the rotation of the reel and the supported wire coil, all that is needed is to either tighten or loosen the adjusting nut so as to provide the necessary side loading tension by the linear force against the inner racers, thereby causing a slight displacement of the ball bearing with respect to all the racers, creating a somewhat binding action which provides a unique braking-control assembly.

The purpose of the tension created by the side loading of the bearings is to keep out the slack between the drive motor and the mounting reel so that when you stop welding the roll of wire does not continue to turn. When you stop, it stops immediately. Therefore, there is no slack in the wire.

This is accomplished by providing side loading on the bearings instead of using a friction break. Therefore this allows one too accomplish the same control by not adding any parts at all.

This apparatus is designed to be mounted on welding machines that use a 30 lb. spool internally where there is not enough room inside of the compartment of the welding machine to position a 60 lb. spool therein. So, therefore, most of the well known machines are required to use a 30 lb. spool. By attaching the present apparatus on the machine, it allows the use of a 60 lb. spool to be externally mounted, thereby eliminating the 30 lb. internal spool, hence the advantage of employing the 60 lb. spool is about two-thirds the cost per lb.

Accordingly, the side loading of this apparatus is to keep out the slack between the drive motor and the coil wire.

Three things begin to happen if you get slack:

1. When you discontinue welding which stops the drive motor, without applied tension the coil or wire continues to turn after the wire is no longer being used by the machine, whereby the wire tends to coil up and disengage from the spool. If this does occur in a manner to allow the wire to fall off the spool and touch the cabinet (there being no insulation), it will burn the wire in two. You have to then pull all the wire out of the gun and start the new end of the wire, feed it into the drive rollers which will pull it into the gun. In other words, the machine must be re-loaded.

2. If it doesn't touch the cabinet, and it merely falls off the reel, the operator has got to physically go over and put the wire back on the coil and take up the slack.

3. If slack does occur but does not produce enough slack that it causes the wire to fall off the spool, the machine will still run with the exception that it will first start the drive motor pulling the wire without pulling the weight of the spool. Hence, it will weld along fine until all the slack is out at which time an abrupt pull on the load will occur and create a momentary stop of the movement of the wire as it is being fed into the machine after which it will start up again. Whereas, with the tension applied all the time, the slack is taken out continuously, so when you start and stop you always get an even smooth continuous welding flow thereby preventing the wire from falling off the reel.

OBJECTS AND ADVANTAGES OF THE INVENTION

The present invention has for an important object a provision whereby a reel assembly for supporting and feeding a continuous length of coiled welding wire includes a unique braking assembly which provides for the applying of an adjustable linear side loading to a pair of ball bearings by increasing or decreasing the tension created by an adjusting nut.

It is another object of the invention to provide a mounting-and-braking apparatus for coiled welding wire wherein the rate of feed of the welding wire can be simply adjusted by skilled and unskilled individuals, alike.

It is a further object of the invention to provide a mounting and braking apparatus that is simple and rugged in construction.

Still a further object of the invention is to provide an apparatus of this character having a relatively long working life.

It is still another object of this invention to provide an apparatus of this character that is so designed that it is capable of supporting either 30 pounds or 60 pounds of coiled welding wire.

It is a further object of the invention to provide an apparatus of this character that is easy to service and maintain.

It is still another object of this invention to provide an apparatus of this character that is relatively inexpensive to manufacture and operate.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
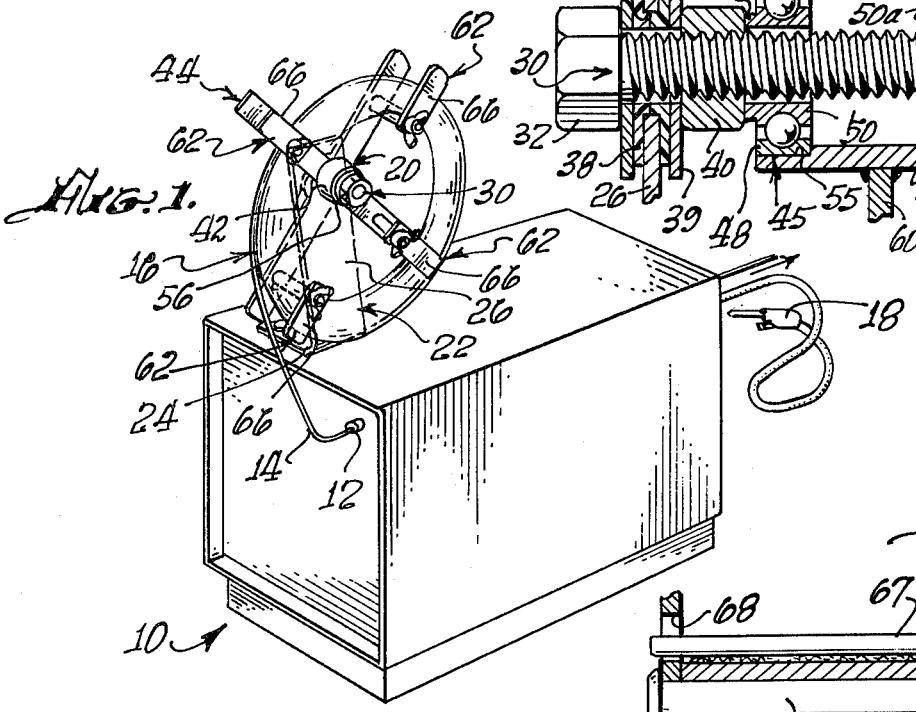
FIG. 1 is a perspective view showing the present invention mounted to a welding machine.

Referring more particularly to the drawing, there is shown in FIG. 1 a welding machine, generally indicated at 10, having a welding wire inlet 12 at one end thereof to receive welding wire 14 as it is released from the main wire roll designated at 16. The welding machine is not herein described in detail, since any well known suitable unit can have the present invention adapted to be operably mounted thereto.

However, there is also shown, for reference purposes, a welding gun or torch 18 being operably connected to the welding machine 10, whereby wire is fed through the machine 10 and into the gun 18 in a continuous manner. That is, the feeding process is controlled by the welding operator at a rate depending on the particular work requirements.

Figure 3:
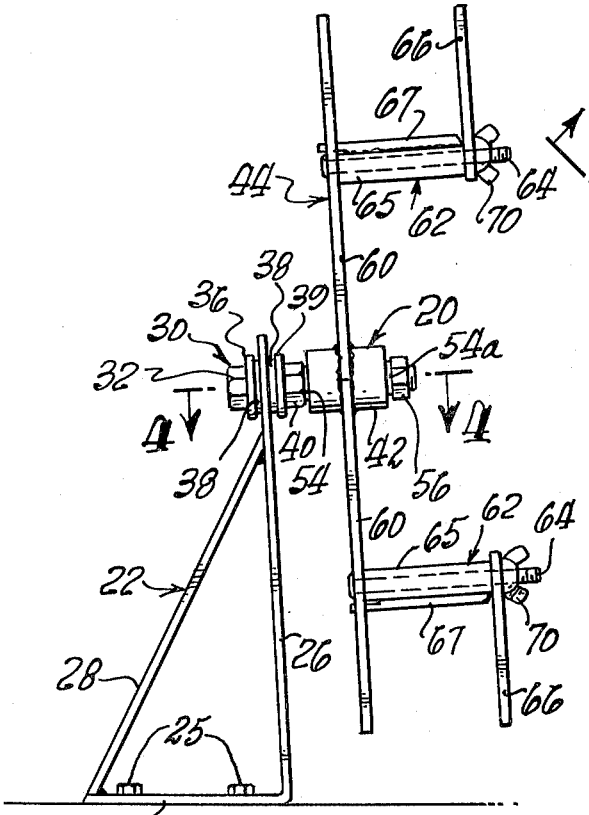
FIG. 3 is a side-elevational view taken along line 3—3 of FIG. 2, showing the vertical portion of the bracket having a slightly inclined configuration.
Figure 2:
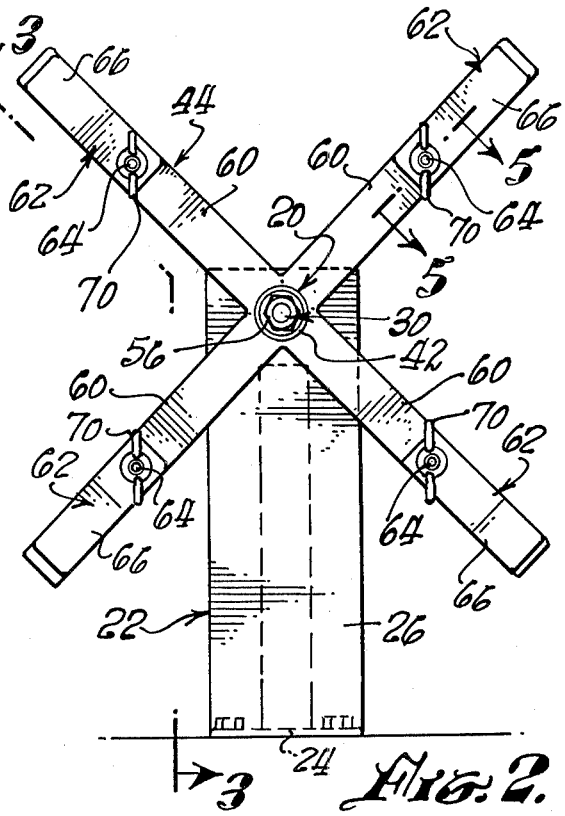
FIG. 2 is an enlarged front plan view thereof.

Accordingly, the present invention is mounted to the welding machine 10, said invention being a mounting and braking apparatus, indicated generally at 20, to aid in the proper feeding speed of the wire 14, wherein the particular speed of the linear movement of the welding wire is controlled. Said mounting and braking apparatus 20 comprises a mounting bracket, designated at 22, having a substantially L-shaped configuration formed by a base member 24 adapted to be mounted to the welding machine by any suitable fastening means; but, for illustrative purposes, bolts 25 are shown. (FIG. 3). Integrally formed with the base plate is an upright leg member 26, said leg being arranged to have an inclination of approximately 2° inwardly from a perpendicular plan. This particular angular position of leg 26 with respect to its base member 24 is held by a brace bore 28.

The upper free end of said leg 26 is provided with an opening 29 by which the braking assembly 20 is operably attached to the mounting bracket 22. Said braking assembly 20 comprises a threaded spindle 30 having a multi-sided head 32, the threaded spindle body 34 being extended through hole or opening 29. Prior to being inserted through opening 29, a washer 36 is positioned adjacent the head 32, followed by an insulating means, said insulating means comprising a grommet 38 having one-half thereof interdisposed between washer 36 and leg 26, whereas the other half of said grommet 38 is interdisposed between the opposite side of leg 26 and washer 39. In order to provide a complete insulating barrier between the braking assembly and its attached components, a nut 40 is positioned against washer 39, thereby compressing each half of the grommet 38 to allow the inward flanges to abut together as if formed like a single member.

At this time, the spindle 34 is firmly affixed to leg 26 and is adapted to receive a hub member 42 which has the reel device, generally indicated 44, secured thereto. The hub is rotatably mounted to the spindle through a pair of ball bearings, which will be referred to as rear bearing 45 and forward bearing 46. Each bearing comprises an outer racer or raceway 48 and **48*a*, respectively, and an inner racer 50 and 50*a*, respectively, having a plurality of ball bearings 52 interdisposed therebetween in the normal well known manner. However, the prominent feature included herein is the laterally, outwardly-extending, annular flanges 54 and 54*a* integrally formed on each respective inner racer 50 and 50*a***.

Figure 4:
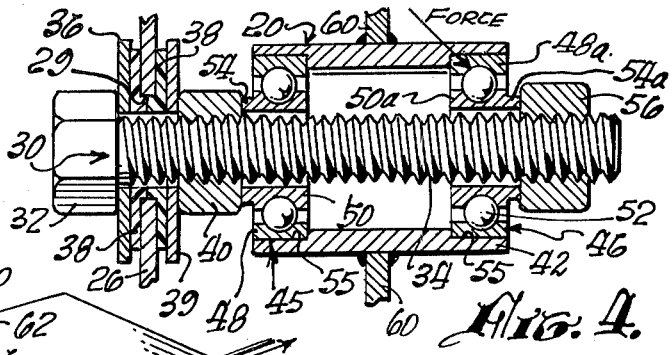
FIG. 4 is an enlarged, cross-sectional view taken substantially along line 4—4 of FIG. 3.

Racers 48 and **48*a* are disposed in annular recesses 55 of the hub member 42, as seen in FIG. 4, hence oppositely positioning each bearing 45 and 46 in hub 42. Following the mounting of the hub and bearings, an adjusting nut 56 is threaded on spindle 34 to a point where it abuts the annular flange 54*a*, and where flange 54 of inner racer 50 abuts against nut 40**.

Figure 5:
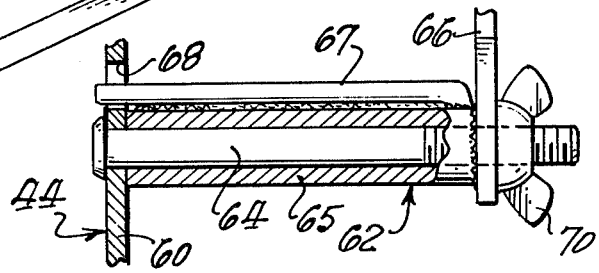
FIG. 5 is an enlarged, cross-sectional view taken substantially along line 5—5 of FIG. 2.

Fixedly attached to the hub 42 and controlled by the braking assembly 20 is the welding wire support rack or reel 44. This reel comprises a spider-like arrangement having a plurality of radially extended arms 60 which are secured to the central portion of the hub 42. Removably attached to each of the arms 60 is a wire-supporting lug, generally designated at 62. Said lug is adapted to support various sizes and weights of coiled welding wire in the form of spool 16, as seen in FIG. 1. This type of reel or rack is well known in the art and is constructed in combination with the respective invention. The lug 62 comprises a pin 64 mounted to an arm 60 over which a sleeve 65 is positioned, the sleeve being provided with a laterally-upright shoulder member 66, wherein the coil of wire is supported between each shoulder member 66 and its respective arm 60. In order to hold the shoulder member in its proper relationship with respect to the arm member, a key pin 67 is affixed to sleeve 65 and is adapted to be received in a key opening 68, whereby said lug 62 is removably held in place by a wing nut 70, as seen in FIG. 5.

Accordingly, when the present invention is assembled and mounted for operation, the rotational speed of the reel must be controlled, whereby the rate the wire is fed into the machine will correspond to the overall welding process. Therefore, it is important to note that the controlling feature is provided by the proper torque applied to the adjusting nut 56. This is due to the lateral forces created by allowing nut 56 to abut directly against the inner racer 54*a* of bearing 46. When nut 56 is tightened against flange 54*a* a lateral, inward force is applied to inner racer 50*a*, forcing ball bearing 52 to bind inwardly in the outer racer 48*a*, wherein this force is transmitted through hub 42 into outer racer 48, where the overall force is transmitted to its respective ball bearing into inner racer 50. Thus, flange 54 of said inner racer 50 forcefully abuts nut 40, again causing a binding action on the ball bearings.

Therefore, it can be seen that, by applying the proper torque to the adjusting nut 56, the rotational speed of the reel and wire coil can be very closely controlled with a single adjustment.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. In combination with a mounting and braking apparatus of the type wherein a coil of welding wire is mounted on a rotating reel, and wherein the wire is fed therefrom at a controlled rate of speed into an electric welding machine for operation therewith, the improvement which comprises:

a mounting bracket for attachment to said welding machine, having a base member and an integrally formed upright leg member provided with an opening therein;

a spindle disposed within said leg member and received through said opening therein;

fastening means to secure said spindle to said leg member;

insulating means disposed between said leg member, said spindle, and said fastening means;

a hub member received over for rotation about said spindle, said hub having said reel secured thereto for controlled rotation therewith;

bearing means interdisposed between said hub member and said spindle, whereby said hub rotates with said bearing means; and an adjusting means in abutting engagement with said bearing means, whereby a varying linear force is applied to said bearing means to cause a controlled binding within said bearing means, thereby regulating the rotational speed of said reel and linear movement of said welding wire.

2. The combination as recited in claim 1, wherein said bearing means comprises:

a forward ball bearing having an outer and inner racer;

a rear ball bearing having an outer and inner racer; and a plurality of balls disposed between said racers;

said inner racer of said rear ball bearing being positioned for engagement with said fastening means, said inner racer of said forward ball bearing positioned for engagement with said adjusting means, whereby linear force can be applied to said racers and said balls, thereby causing a controlled movement therebetween.

3. The combination as recited in claim 2, wherein each of said inner racers includes annular, outwardly extending flanges for direct engagement with said fastening means and said adjusting means.

4. The combination as recited in claim 3, wherein said adjusting means comprises a threaded nut threadably received on said spindle, said nut engaging said annular flange of said inner racer of said forward bearing.

5. The combination as recited in claim 4, wherein said fastening means comprises:

a nut head integrally formed as part of said spindle;

a pair of washers oppositely disposed on each side of said leg of said bracket, said washers abutting said insulating means; and a nut threadably received on said spindle and interdisposed between said annular flange of said inner racer of said rear bearing and one of said washers.

6. The combination as recited in claim 5, wherein said insulating means comprises a grommet of insulating material, said grommet being formed by half sections, wherein each section is interdisposed between said washers and said leg member.

* * * * *